US006053629A

United States Patent [19]

Nakashima

[11] Patent Number: 6,053,629

[45] Date of Patent: Apr. 25, 2000

[54] VIBRATION GENERATING DEVICE

[75] Inventor: Hisashi Nakashima, Fuwa-gun, Japan

[73] Assignee: Teijin Seiki Co., Ltd., Osaka, Japan

[21] Appl. No.: 09/170,203

[22] Filed: Oct. 13, 1998

[30] Foreign Application Priority Data

Oct. 23, 1997 [JP] Japan ..... 9-309191

[51] Int. Cl.[7] ..... B01F 11/00

[52] U.S. Cl. ..... 366/124; 91/232

[58] Field of Search ..... 366/124, 125; 173/133; 91/232, 234

[56] References Cited

U.S. PATENT DOCUMENTS

| | | | |
|---|---|---|---|
| 2,880,974 | 4/1959 | Schaedler | 366/124 |
| 3,005,443 | 10/1961 | Paulson | 173/133 |
| 3,879,018 | 4/1975 | Hunter | 366/124 |
| 4,170,924 | 10/1979 | Hunt | 91/232 |
| 4,588,300 | 5/1986 | Guy | 366/124 |
| 5,209,564 | 5/1993 | Manci et al. | 366/124 |

FOREIGN PATENT DOCUMENTS

| | | |
|---|---|---|
| 7-119615 | 5/1995 | Japan . |
| 7-232132 | 9/1995 | Japan . |
| 9-105140 | 4/1997 | Japan . |

*Primary Examiner*—Tony G. Soohoo
*Attorney, Agent, or Firm*—Oliff & Berridge, PLC

[57] ABSTRACT

A vibration generating device is provided. Where a bucket link is replaced by the vibration generating device, the vibration generating device is connected to a main operating valve by conduits. Since both flow rate control valve and fluid motor are housed within a casing, a high pressure conduit for connecting the vibration generating device and main operating valve is not necessitated, thereby making the structure compact, and making the working of conduit arrangement easy and improve reliability. The center axial line of the cylinder chamber, rotary axial line of the valve element of the rotary valve and center axial line of the valve element of the flow rate valve are made parallel to one another so that these cylinder chamber, rotary valve and flow rate control valve are arranged in a superposing fashion, thereby making the entire vibration generating device compact.

2 Claims, 5 Drawing Sheets

VIBRATION GENERATING DEVICE

BACKGROUND OF THE INVENTION

The present invention relates to a vibration generating device for generating a vibration by alternately guiding a high pressure fluid to both sides of a vibration-generating piston.

Generally, an engineering/construction machine such as a hydraulic shovel (excavator) is used for digging up earth and sand, ground levelling, piling, etc. Such work is carried out in a manner of operating a boom cylinder, arm cylinder and bucket cylinder of the hydraulic shovel, as necessity requires, to scoop earth and sand by a bucket, or pushing the pile against the earth. Where the bucket hits a great stone while the earth and sand are dug up as described above, if a high frequency vibration is given to the bucket to increase digging force, the great stone can be easily dug up. This is an experientially known fact. Further, it is also known that if the vibration at a short period is given to the bucket when performing the ground levelling, piling or shaking off the earth and sand applied on the bucket, these operations can be carried out smoothly in a short time.

Therefore, as disclosed in JP-A-9-105140, in order to improve workability, it has been proposed to replace a bucket link coupling the tip (tilt link) of a piston rod of a bucket cylinder with the bucket by a vibration actuator for generating the vibration at the site of working as necessity requires so that the vibration generated by the vibration actuator is transmitted to the bucket. The vibrator actuator includes a block-shaped casing with a pair of supply openings for supplying high pressure fluid and an exhaust opening for exhausting low pressure fluid; a vibration-generating piston which is housed slidably in a cylinder formed within the casing; a rotary valve which is connected to the one supply opening and exhaust opening through a supply passage and an exhaust passage, respectively and also connected to both cylinder chambers on both sides of the vibration-generating piston through a pair of fluid passages, and rotates to communicate the supply passage with the cylinder chambers on both sides alternately to guide the high pressure fluid to both cylinder chambers, alternately; and a fluid motor which is housed in the casing and connected to the other supply passage and exhaust passage through a high pressure passage and a low pressure passage, respectively, and is operated by the high pressure fluid supplied through the high pressure passage to provide rotary force to the rotary valve. A flow rate control valve for controlling the flow rate of a high pressure fluid supplied to the fluid motor is attached to the stem of an arm. The flow rate control valve and a main operating valve are connected by a single high pressure conduit, the flow rate control valve and the pair of supply opening of the vibration actuator are connected by a pair of (two) high pressure conduits, and the exhaust opening of the vibration actuator and the main operating valve are connected by a single low pressure conduit.

However, in the conventional vibration generating device described above, when the bucket link is replaced by the vibration actuator, the vibration actuator must be connected to the flow rate control valve and the main operating valve using three conduits. This work is troublesome. In addition, the main operating valve, flow rate control valve and vibration actuator must be connected to one another using four conduits, as described above. This make the structure complicate. Further, use of many conduits may produce leakage of liquid at the conduit coupling portion and damage of the conduits due to their rubbing against each other. This attenuates the reliability of the vibration generating device.

SUMMARY OF THE INVENTION

An object of the present invention is to provide a vibration generating device which is simple in structure and can be easily replaced and improve reliability.

Such an object can be attained by a vibration generating device comprising:

a block-shaped casing having a supply opening to which a high pressure fluid is supplied and an exhaust opening from which a low pressure is exhausted; a vibration-generating piston slidably housed in a cylinder chamber formed in the casing; a rotary valve housed within said casing, which is connected to the supply opening and the exhaust opening through a supply passage and an exhaust passage, respectively and also connected to both cylinder chambers of the vibration-generating piston though a pair of fluid passages, the rotary valve rotating to communicate the supply passage with the cylinder chambers on both sides alternately, thereby alternately guiding the high pressure fluid to both cylinders; a fluid motor housed within said casing, which is connected to a supply intermediate passage and an exhaust intermediate passage communicating with the supply passage and the exhaust passage, respectively, the fluid motor being operated by the high pressure fluid supplied to the supply intermediate passage, thereby giving rotary force to the rotary valve; and a flow rate control valve within the casing, which is mounted on the way of the supply intermediate passage, the flow rate control valve controlling an amount of the high pressure fluid supplied to the fluid motor, the center axial line of the cylinder chamber, rotary axial line of the valve element of the rotary valve and center axial line of the valve element of the flow rate valve are preferably made parallel to one another so that these cylinder chamber, rotary valve and flow rate control valve are arranged in a superposing fashion.

Where the vibration generating device described above is applied to engineering/construction machine such as a hydraulic shovel, although replacement of the bucket link is made, the flow rate control valve and fluid motor are also housed within the casing of the vibration generating device. Therefore, the high pressure conduit used to connect the flow rate control valve and fluid-motor is not required so that only two fluid supply/exhaust openings, i.e. supply opening and exhaust opening are provided in the vibration generation device. As a result, the vibrating generating device and the main operating valve of the hydraulic shovel are connected by only two conduits so that the work of installing the conduits can be made simple. Since the main operating valve and vibration generating device are connected by the two conduits, the structure is simple, and leakage of fluid and damage of the conduits due to their rubbing against each other can be suppressed. Further, the center axial line of the cylinder chamber, rotary axial line of the valve element of the rotary valve and center axial line of the flow rate control valve are made parallel to one another so that the cylinder chamber, rotary valve and flow rate control valve are arranged in a superposing fashion. This make the entire vibrating generating device compact. As a result, the vibrating generating device can be received within a width of the tilt link of a hydraulic shovel, thereby preventing the device from being damaged due to collision with rock, for example.

Where a vibration is given to the bucket using the vibration generating device mounted on the hydraulic shovel, the high pressure fluid is supplied to the vibration generating device through the supply opening, and also supplied to the fluid motor through the supply passage, supply intermediate passage and flow rate control valve. As result, the fluid motor operates to rotate the rotary valve so that the supply passage is communicated with the cylinder chambers on both sides alternately. At this time, since the high pressure fluid is supplied to the rotary valve through the supply passage, it is guided to both cylinder chambers alternately. Thus, the vibration-generating piston in each of the cylinder chambers moves reciprocatively at a short period in an axial direction to vibrate so that the vibration is applied to the bucket. In this case, the period of the vibration can be changed by controlling the flow rate of the high pressure fluid supplied to the fluid motor by the flow rate control valve. Incidentally, the low pressure fluid exhausted from the cylinder chambers and fluid motor are exhausted from the exhaust opening through the fluid passage, exhaust intermediate passage and exhaust passage on the low pressure side.

DETAILED DESCRIPTION OF THE PREFERRED EMBODIMENT

Figure 1:
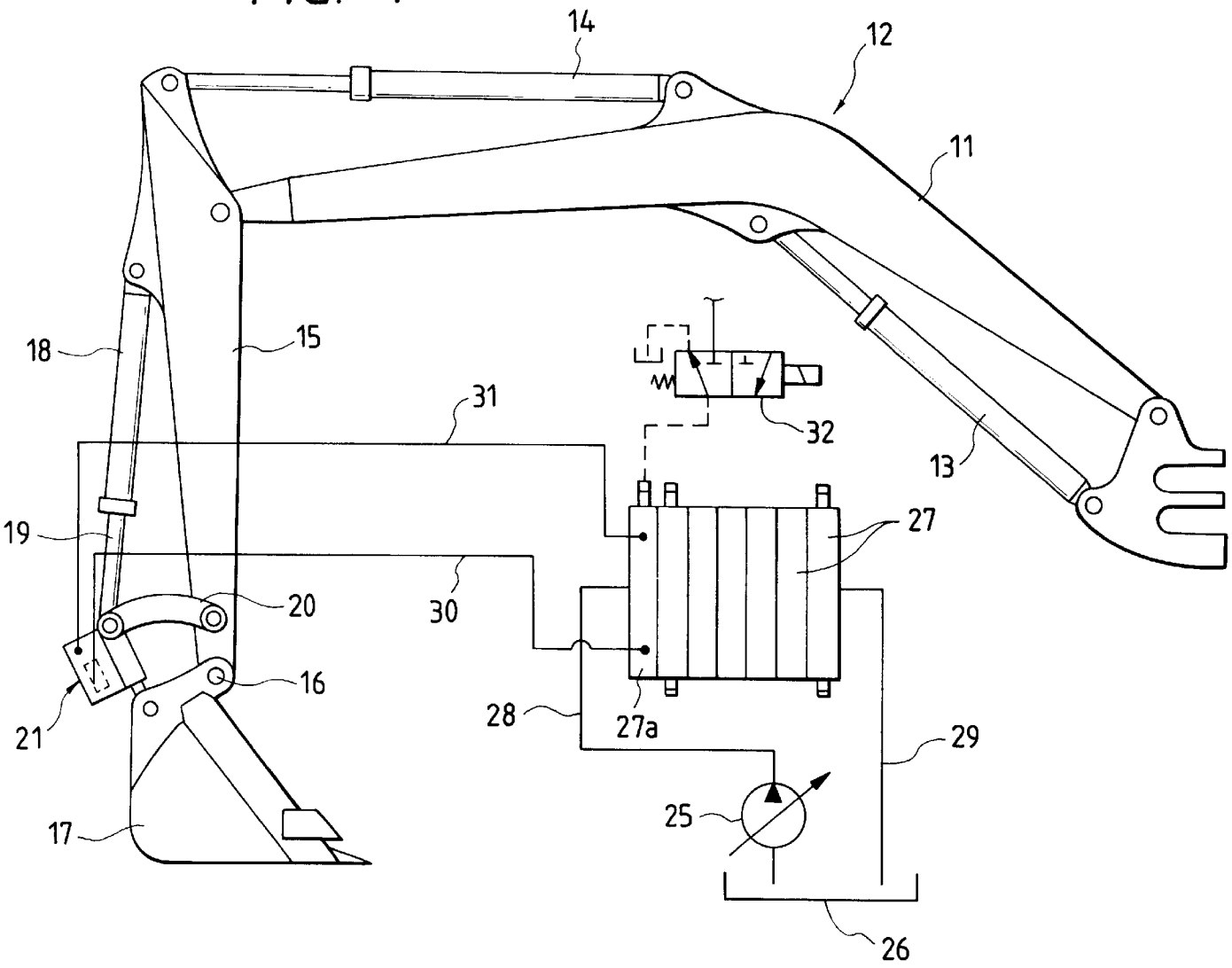
FIG. 1 is a schematic front view of an embodiment of the present invention applied to a hydraulic shovel.

Now referring to the drawings, an explanation will be given of an embodiment of the present invention.

In FIG. 1, reference numeral 11 denotes a boom of a engineering/construction machine such as a hydraulic shovel (excavator) 12. The boom 11 is swingably coupled with a travelling frame (not shown) of the hydraulic shovel 12 and is adapted to swing vertically on a stem by a boom cylinder 13. The stem of an arm 15 swung vertically by an arm cylinder 14 is coupled with the tip of the boom 11. A bucket 17 for digging up earth and sand through a pin 16 is coupled with the tip of the arm 15. Reference numeral 18 denotes a bucket cylinder with a head side coupled with the stem of the arm 15. A tilt link 20, which is swingably coupled with the tip, is coupled with the tip of a piston rod 19 of the bucket cylinder 18. When a normal work is done such as digging-up of earth and sand, ground levelling, piling, etc. the tilt link 20 and the bucket are being coupled with each other by a bucket link (not shown). But, when a vibration at a short period is to be given to the bucket 17, the bucket link is replaced by the vibration generating device 21.

Reference numerals 25 and 26 refer to a fluid pump and a tank installed on a travelling frame of the hydraulic shovel 12, respectively. These fluid pump 25 and tank 26 are connected to a plurality of main operating valves 27 installed on the travelling frame through a discharge passage 28 and an exhaust passage 29, respectively. The pressure fluid (high pressure oil) supplied from the fluid pump 25 to the main operating valves 27 is supplied through a supply conduit to the boom cylinder 13, arm cylinder 14, bucket cylinder 18, vibration generating device 21, etc., thereby operating the boom cylinder 13 and others. The low pressure fluid exhausted from the boom cylinder 13 and others is returned to the tank 26 through an exhaust conduit, main operating valves 27 and exhaust passage 29. In this case, a solenoid valve 32 is connected to the main operating valve 27*a* connected to the vibration generating device 21. By switching the solenoid valve 32, a pilot pressure is supplied to the main operating valve 27*a* so that the main operating valve is switched.

Figure 2:
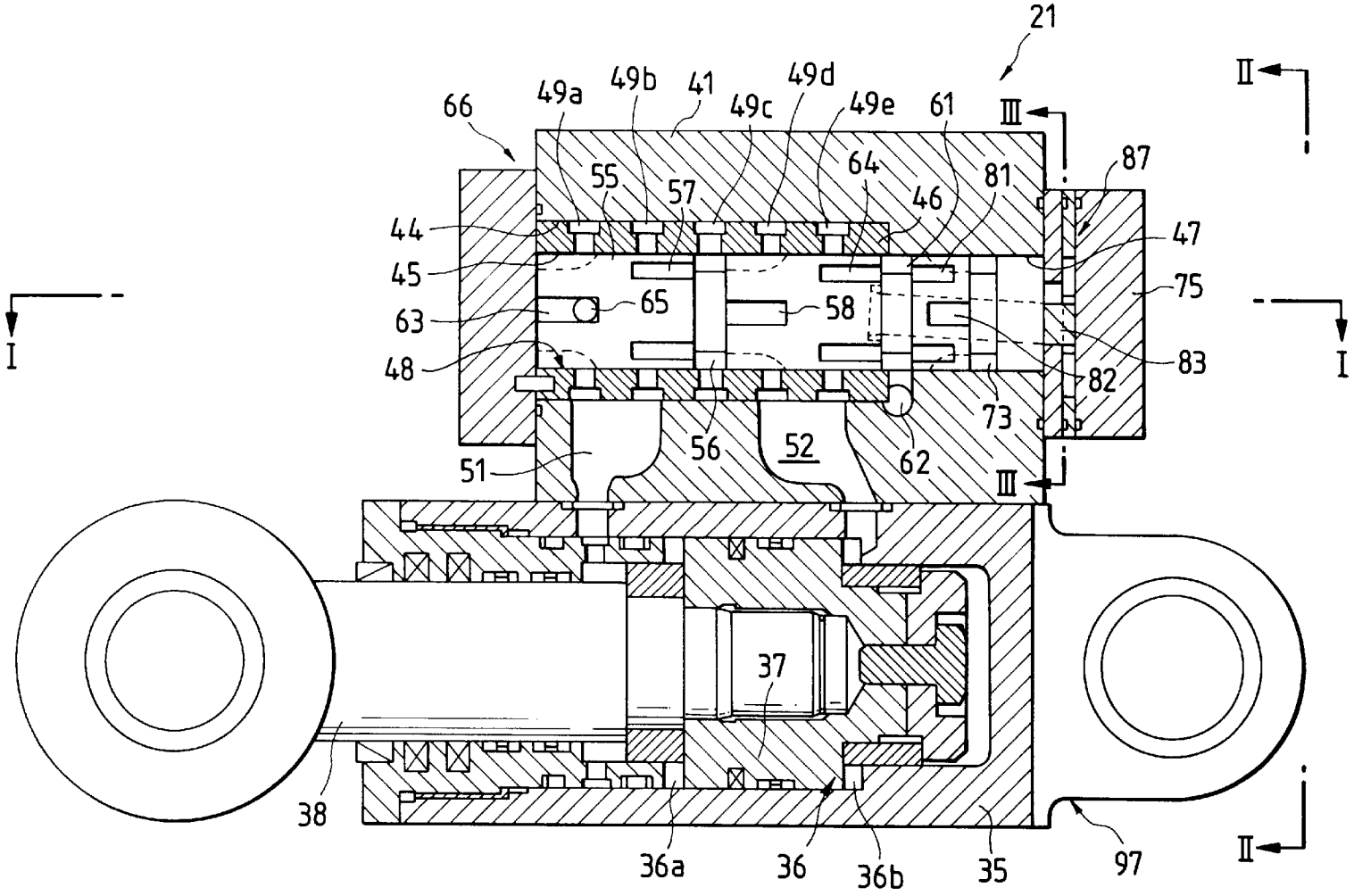
FIG. 2 is a front sectional view of the vibration generating device.
Figure 3:
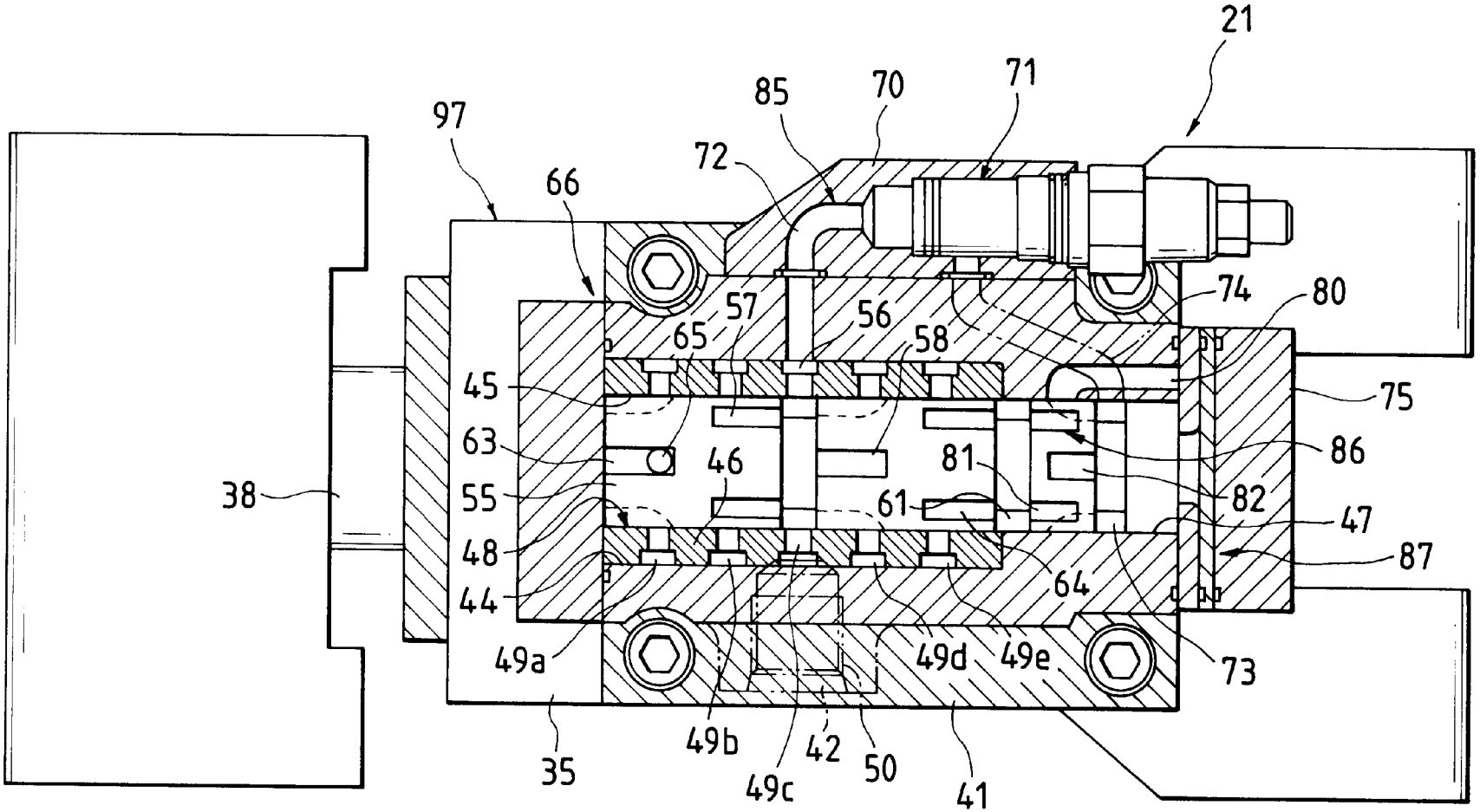
FIG. 3 is a sectional view taken in arrow I—I in FIG. 2.
Figure 4:
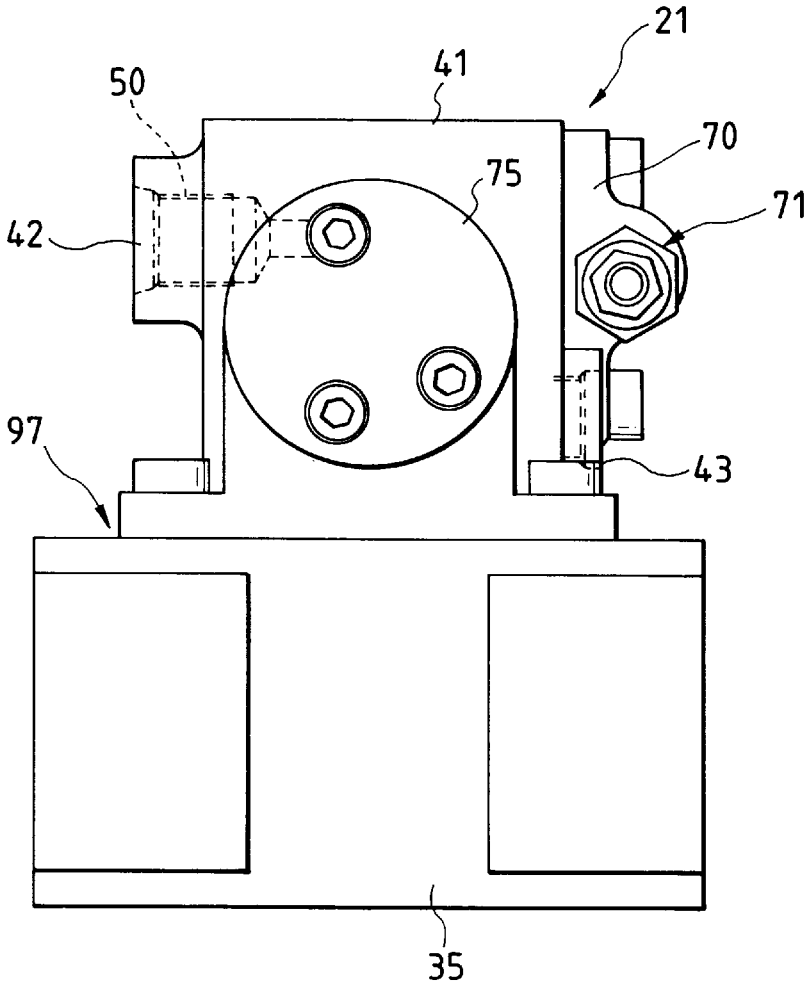
FIG. 4 is a sectional view taken in arrow II—II in FIG. 2.
Figure 5:
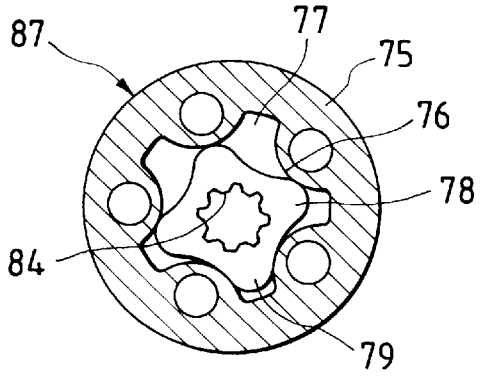
FIG. 5 is a sectional view taken in arrow III—III in FIG. 2.

In FIGS. 2, 3 and 4, the vibration generating device 21 has a cylinder block 35 with a rear end coupled with the tilt link 20. A cylinder chamber 36 extending in a front-rear direction is formed within the cylinder block. A vibration-generating piston 37 is slidably housed in the cylinder chamber 36. Thus, the cylinder chamber 36 is partitioned into a front cylinder chamber 36*a* and a rear cylinder chamber 36*b*. Reference numeral 38 denotes a piston rod with a read end coupled with the vibration-generating piston 37 and extending forward in an axial direction. The front end protruding from the cylinder block of the piston rod 38 is coupled with the bucket 17.

Reference numeral 41 is a valve block secured to the upper surface of the cylinder block 35. On the sides of the valve block 41, a supply opening 42 and exhaust opening 43 coupled with the supply conduit 30 and exhaust conduit 31, respectively are formed. The high pressure fluid is supplied to the supply opening 42 through the supply conduit 30, and the returning low pressure fluid is exhausted from the exhaust opening 43 into the exhaust conduit 31. At the front side within the valve block 41, a housing hole 44 extending in parallel to the cylinder chamber 36 is formed. In the housing hole 44, a cylindrical sleeve 46 with an axial hole coaxial with the holding hole is fixedly housed. At the rear side within the valve block 41, an axial hole 47 is formed which is coaxial with the axial hole 45 and has a diameter equal to that of the axial hole 45. These axial holes 45 and 47 are communicated with each other to provide a valve hole 48. The sleeve 46 has five passages 49*a*, 49*b*, 49*c*, 49*d* and 49*e* spaced apart from one another in an axial direction. Each of the passages 49*a*–49*e* is composed of a ring-shaped groove extending circumferentially on the outer periphery of the sleeve 46 and a plurality of holes extending radially to the valve hole 48. The passage 49*c* and the supply opening 42 are connected to each other by a supply passage 50 formed in the valve block 41. Reference numerals 51 and 52 denote a pair of fluid passages formed apart in a longitudinal direction within the valve block 41. The front fluid passage 51 connects the passages 49*a*, 49*b* to the front cylinder chamber 36*a*, respectively, and the rear fluid passage 52 connects the passages 49*d*, 49*e* to the rear cylinder chamber 36*b*, respectively.

Reference numeral 55 denotes a valve element rotatably housed within the valve hole 48. The rotary axial line of the valve element 55 is in parallel to the center axial line of the cylinder chamber 36. On the periphery of the valve body 55 opposite to the passage 49*c*, a supply ring-shaped groove 56 is formed. The high pressure fluid is supplied to the supply ring-shaped groove 56 through the supply passage 50 and the passage 49*c*. Reference numerals 57 and 58 denote a plurality of supply concave grooves formed apart at equal pitches circumferentially on the outer periphery of the valve body 55. The supply concave groove 57 extends forward in the axial direction from the supply ring-shaped groove 56 to the position oppositable to the passage 49*b*. The supply concave groove 58 extends backward in the axial direction from the supply ring-shaped groove 56 to the position oppositable to the passage 49*d*. The supply concave grooves 57 and 58 are arranged circumferentially alternately and displaced circumferentially from each other by a ½ pitch. As a result, when the valve body 55 rotates, the passage 49*b* and the supply concave groove 57, and the passage 49*d* and the supply concave groove 58 are communicated with each other alternately. Thus, the supply passage 50 is alternately communicated with the fluid passage 51 and front cylinder chamber 36*a*, and the fluid passage 52 and rear cylinder chamber 36*b*. Accordingly, the high pressure fluid in the supply ring-shaped groove 56 is alternately guided to the passages 49*b* and 49*d* through the supply concave grooves 57 and 58. Further, the high pressure fluid supplied to the passage 49*b* is guided to the rear cylinder 36*a* through the fluid passage 51, while the high pressure fluid supplied to the passage 49*d* is guided to the rear cylinder chamber 36*b* through the fluid passage 52. In this way, when the high pressure fluid is supplied to the cylinder chambers 36*a* and 36*b* on both sides of the vibration-generating piston 37, the vibration-generating piston 37 shuttles to and fro at a short period in the axial direction, thereby generating a high frequency vibration.

Reference numeral 61 denotes an exhaust ring-shaped groove formed at the position opposite to the boundary between the axial hole 45 and the axial hole 47 on the outer periphery of the valve body 55. The exhaust ring-shaped groove 61 is connected to the exhaust opening 43 through an exhaust passage 62 formed in the valve block 41. Reference numerals 63 and 64 denote a plurality of exhaust concave grooves formed apart at equal pitches circumferentially on the outer periphery of the valve body 55. The exhaust concave groove 63 extends backward in the axial direction from the front end of the valve body 55 to the position oppositable to the passage 49*a*, and also communicates with the exhaust ring-shaped groove 61 through a hole 65 formed within the valve body 55. On the other hand, the exhaust concave groove 64 extends forward in the axial direction from the exhaust ring-shaped groove 61 to the position oppositable to the passage 49*e*. These exhaust concave grooves 63 are arranged at the same circumferential positions as the supply concave grooves 58, while the exhaust concave grooves 64 are arranged at the same circumferential positions as the supply concave grooves 57. Therefore, when the high pressure fluid is supplied to the front cylinder chamber 36*a* through the supply concave groove 57, passage 49*b* and fluid passage 51, the low pressure fluid extruded from the rear cylinder chamber 36*b* is exhausted into the exhaust ring-shaped through the fluid passage 52, passage 49*e* and exhaust concave groove 64. On the other hand, when the high pressure fluid is supplied to the rear cylinder chamber 36b through the supply concave groove 58, passage 49*d* and fluid passage 52, the low pressure fluid extruded from the front cylinder chamber 36*a* is exhausted into the exhaust ring-shaped groove 61 through the fluid passage 51, passage 49*a*, exhaust concave groove 63 and hole 65. The above sleeve 46 and valve element 55, as a whole, are connected to the supply passage 50 and exhaust passage 62 through the supply opening 42 and exhaust opening 43, respectively, and also connected to the cylinder chambers 36*a* and 36*b* on both sides of the vibration generating piston 37 through the pair of fluid passages 51 and 52, respectively. The valve element 55 rotates to communicate the supply passage 50 with the cylinders 36*a* and 36*b* alternately, thereby constituting a rotary valve 66 capable of alternately guiding the high pressure fluid to both cylinders 36*a* and 36*b*. Incidentally, the detailed structure of the rotary valve is disclosed in e.g. JP-A-7-232132.

In FIGS. 2, 3, 4 and 5, reference numeral 70 denotes a side block secured to the side of the valve block 41. Within the side block 70, the flow rate control valve 71 is arranged which is superposed with the cylinder chamber 36 and rotary valve 66 at their positions in the axial direction. The flow rate control valve 71 is connected to the supply passage 50 through the first intermediate passage 72 and passage 49*c* formed within the valve block 41 and side block 70. On the outer periphery of the valve element 55 behind the exhaust ring-shaped groove 61, a supply ring-shaped groove 73 is formed. The supply ring-shaped groove 73 is connected to the flow rate control valve 71 through the second intermediate passage 74 formed within the valve block 41 and side block 70.

Reference numeral 75 denotes a motor block attached to the rear end of the valve block 41. Within the motor block 75, a motor chamber 77 with plural, now five, inner teeth 76 formed on the inner periphery is provided. Within the motor chamber 77, an outer wheel 79 with plural, now four, by one fewer than that of the inner teeth by one, outer teeth formed on the outer periphery is provided. Reference numeral 80 denotes one of a plurality of connection passages formed at the rear end of the valve block 41 and separated circumferentially. The front end of the connection passage 80 opened into the valve hole 48 so as to oppose to the valve element 55 between the exhaust ring-shaped groove 61 and supply ring-shaped groove 73, while the rear end thereof communicates with the motor chamber 77. Reference numerals 81 and 82 denote a plurality of supply and exhaust concave grooves formed apart at equal pitches circumferentially on the outer periphery of the valve body 55. The exhaust concave groove 81 extends backward in the axial direction from the exhaust ring-shaped groove 61 to the position oppositable to the connection passage 80. The supply concave groove 82 extends forward in the axial direction from the supply ring-shaped groove 73 to the position oppositable to the connection passage 80. The exhaust and supply concave grooves 81 and 82 are arranged circumferentially alternately and displaced circumferentially from each other by a ½ pitch. As a result, when the valve body 55 rotates, the high pressure fluid is supplied to the motor chamber 77 in a circumferentially displaced manner through the connection passage 80 communicating with the supply concave groove 82. Thus, the outer wheel 79 is pushed by the supplied high pressure fluid to rotate eccentrically. Then, the low pressure fluid within the motor chamber 77 is exhausted into the exhaust ring-shaped groove 61 through the connection passage 80 communicating with the exhaust concave groove 81.

Reference numeral 83 denotes a coupling rod with its front end inserted into a coupling hole (not shown) formed at the rear end of the valve element 55, and oscillatably and wholly rotatably coupled with the valve element. The rear end of the coupling rod 83 is inserted into a spline hole 84 formed in the outer wheel 79 and oscillatably spline-connected to the hole 84. As a result, the eccentric rotation of the outer wheel 79 is transmitted to the valve element 55 through the coupling rod 83 so that the valve element 55 is rotated around the rotary axis. The above first and second intermediate passages 72, 74 and the connection passage 80 communicating with the supply ring-shaped groove 73 and supply concave groove 82 constitute a supply intermediate passage 85 communicating with the supply passage 50. The flow rate intermediate passage 85 communicating with the supply passage 50 is mounted on the way of the supply intermediate passage 85. The connection passage 80 communicating with the exhaust concave groove 81 constitutes, as a whole, an exhaust intermediate passage 86 communicating with the exhaust passage 62. Further, the motor chamber 77 and outer wheel 79 are connected, as a whole, to the supply intermediate passage 85 and exhaust intermediate passage 81, 73, 86 and constitute an inscribed wheel type fluid motor 87 which is operated by the high pressure fluid supplied through the supply intermediate passage 85 to provide rotary force to the valve element 55 of the rotary valve 66. The detailed structure of such a fluid motor is disclosed in e.g. JP-A-7-119615.

Figure 6:
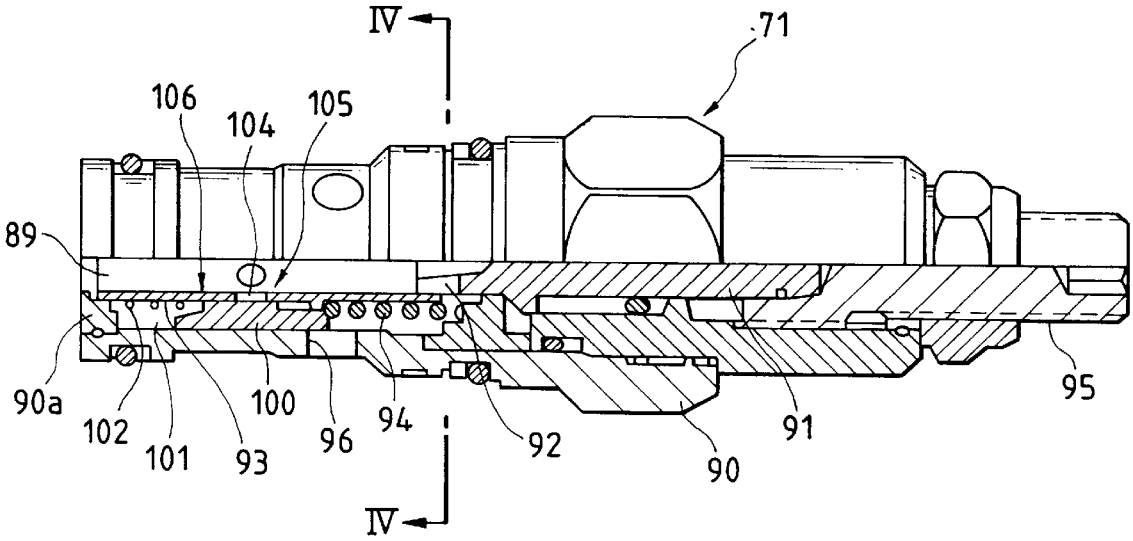
FIG. 6 is a partially broken front view of a flow rate control valve.
Figure 7:
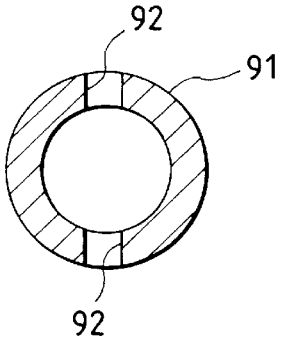
FIG. 7 is a sectional view taken in arrow IV—IV in FIG. 6.

In FIGS. 3, 6 and 7, the flow rate control valve 71 has a cylindrical outer sleeve 90 with a valve chamber 89 formed in the interior. The front end of the valve chamber 89 is communicated with the first intermediate passage 72. In the center portion of the valve chamber 89, a valve element 91 movable in the axial direction of the outer sleeve 90 is inserted. The valve element 91 is provided with plural, now two, slits extending in the axial direction at its front end. The center axial line thereof extends in parallel to the rotary axial line of the valve element 55. Reference numeral 93 denotes an inner sleeve housed in the front end of the valve chamber 89. The inner sleeve 93 is attached to an outer sleeve 90 in such a fashion that it is pressed against a front end flange 90*a* of an outer sleeve 90 by a spring 94. In the rear end of the inner sleeve 93, the rear end of the valve element 91 is slidably inserted. In this case, a part of the slit 92 is blocked by the inner sleeve 93 to suppress passage of the pressure fluid. Reference numeral 95 denotes an adjusting screw screwed in the rear end of the outer sleeve 90. The front end of the adjusting screw 95 is coupled with the valve element 91. Therefore, when the adjusting screw 95 is rotated to change the screwing position, the valve element 91 moves in the axial direction so that the overlapping degree of the valve element and inner sleeve 93 varies. Thus, the opening area of the slit 92 (passage area of the pressure fluid) can be adjusted. Reference numeral 96 denotes a through-hole formed at the front end of the outer sleeve 90. The through-hole 96 penetrates from the inner wall of the outer sleeve 90 to the outer wall thereof and communicates with the above second intermediate passage 74. The outer sleeve 90, valve element 91, inner sleeve 93, spring 94 and adjusting screw 95 are mounted as a whole on the way of the supply intermediate passage 85 and constitute the flow rate control valve 71 for controlling the flow rate of the high pressure fluid. The above cylinder block 35, valve block 41, side block 70 and motor block 75 constitute as a whole a block-shaped casing 97. Within the casing 97, the cylinder chamber 36 is formed and the rotary valve 66, flow rate control valve 71 and fluid motor 87 are also housed.

Reference numeral 100 denotes a cylindrical valve element slidably housed in a gap between the outer sleeve 90 and inner sleeve 93. The valve element 100 is urged backward by a spring 102 interposed between the valve element 100 and front end flange 90*a* so as to be brought into contact with the spring 94. Reference 104 denotes one of a plurality of through-holes formed at the central part in the axial direction of the inner sleeve 93. These through-holes 104 are generally blocked by the valve element 100. When the force of the fluid within the second intermediate passage 74 pressed against the valve element 100 by the urging force of the spring 102 increases, the valve element 100 moves forward to open the through holes 104 so that the first intermediate passage 72 and second intermediate passage 74 are communicated with each other. The above gap 101 and through-holes 104 constitute, as a whole, the supply intermediate passage 85 before and after the valve element of the flow rate control valve 91, specifically connection passage 105 which connects the first intermediate passage 72 and second intermediate passage 74. The valve element 100 and spring 102 are mounted as a whole on the way of the connection passage 105, and when opened, constitute a check valve 106 which returns the fluid in the second intermediate passage 74 to the first intermediate passage 72 through the connection passage 105.

An explanation will be given of the operation of the one embodiment of the present invention.

Now it is assumed that a normal work, e.g. digging-up of earth and sand is being carried out by the hydraulic shovel 12. In this case, the tilt link 20 of the hydraulic shovel 12 is coupled with the bucket 17 by the bucket link so that the movement of the piston rod 19 of the bucket cylinder 18 is transmitted to the bucket 17 through the bucket link, thereby swinging the bucket 17. Where large stones are dug up using the hydraulic shovel 12, at the site of working, the bucket link is detached and replaced by the vibration generating device 21. In this case, the vibration generating device 21 is connected to the main operating valve 27*a* by the conduit. But, as described above, both flow rate control valve 71 and fluid motor 87 are housed within the casing 97 of the vibration generating device 21 so that the high pressure conduit which has been conventionally used to connect the flow rate control valve and fluid motor to each other is not necessitated. Therefore, only two supply/exhaust openings of fluid of the supply opening 42 and exhaust opening 43 are provided in the vibration generating device. As a result, the vibration generating device 21 and the main operating valve 27*a* of the hydraulic shovel 12 have only to be connected to each other by two conduits, i.e. supply conduit 30 and exhaust conduit 31, thereby simplifying the work of conduit arrangement. Further, since the main operating valve 27*a* and vibration generating device 21 are connected by two conduits 30 and 31, the entire structure of the vibration generating device can be made simple. In addition, leakage of fluid and damage of the conduits due to their rubbing against each other can be suppressed, thereby improving reliability of the vibration generating device. Moreover, in the vibration generating device 21, the center axial line of the cylinder chamber 36, rotary axial line of the valve element of the rotary valve 66 and center axial line of the valve element 91 of the flow rate valve 71 are made parallel to one another so that these cylinder chamber 36, rotary valve 66 and flow rate control valve are arranged in a superposing fashion. Thus, the entire vibration generation device 21 can be made compact so that it can be received within the tilt link 20 of the hydraulic shovel 12. Accordingly, where deep digging is performed using such a hydraulic shovel, the vibration generating device 21 can be prevented from colliding with rock and others.

Where a vibration is given to the bucket 17 using the vibration generating device 21 mounted in the hydraulic shovel 12, the main operating valve 27*a* is switched by the solenoid valve 32 so that the high pressure fluid discharged from the fluid pump 25 is supplied to the supply opening 42 of the vibration generating device 21 through the discharge passage 28 and supply passage 30. Thereafter, the high pressure fluid is supplied to the motor chamber 77 of the fluid motor 87 through the supply passage 50, first intermediate passage 72, valve chamber 89 of the flow rate control valve 71, slit 92, through-hole 96, second intermediate passage 74, supply ring-shaped groove 73 and connection passage 80 communicating with the supply concave groove 82, thereby rotating the outer wheel of the fluid motor 87 eccentrically. The rotation of the outer wheel 79 is transmitted to the valve element 55 of the rotary valve 66 through the coupling rod 83, thereby rotating the valve element 55.

Thus, the supply passage 50 is alternately communicated with the fluid passage 51 (and front cylinder chamber 36*a*) and fluid passage 52 (and rear cylinder chamber 36*b*). At this time, the high pressure fluid is also supplied to the rotary valve 66 through the supply passage 50 so that when the valve element 55 rotates, the high pressure fluid is alternately supplied to the passages 49*b* and 49*d* through the supply ring-shaped groove 56 and supply concave grooves 57 and 58. In this case, the high pressure fluid supplied to the passage 49*b* is guided to the front cylinder chamber 36*a* through the fluid passage 51, whereas the high pressure fluid supplied to the passage 49*d* is guided to the front cylinder chamber 36*b* through the fluid passage 52. Thus, the high pressure fluid is alternately supplied to the cylinder chambers 36*a* and 36*b* on both sides of the vibration-generating piston 37. Accordingly, the vibration-generating piston 37 within the cylinder chamber 36 moves reciprocatively at a short period in the axial direction to generate a high frequency vibration. This vibration is transmitted to the bucket 17 through the piston rod 38, thereby vibrating the bucket 17.

Further, since the connection passage 80 which supplies the high pressure fluid with rotation of the valve element 55 is gradually displaced circumferentially, the high pressure fluid is also supplied to the motor chamber 77 while it is displaced circumferentially. Thus, the outer wheel 79 of the fluid motor 87 continues to rotate. Now, since the period of vibration of the vibration generating piston 37 depends on the opening area of the slit 92 of the flow rate control valve 71, if the opening area is adjusted by shifting the screwing position of the adjusting screw 95 so that the high pressure fluid flow rate supplied to the fluid motor 87 is controlled, the vibration period of the vibration generating piston 37 can be easily varied. The low pressure fluid alternately extruded from the front cylinder chamber 36*a* or the rear cylinder chamber 36*b* is exhausted into the exhaust ring-shaped groove 61 through the fluid passage 51, passage 49*a*, exhaust concave groove 63 and hole 65, or fluid passage 52, passage 49*e* and exhaust concave groove 64, and thereafter returned to the tank 26 through the exhaust passage 62, exhaust 43, exhaust conduit 31 and exhaust passage 29. The low pressure fluid exhausted from the motor chamber 77 of the fluid motor 87 is exhausted into the exhaust ring-shaped groove 61 through the connection passage 80 communicating with the exhaust concave groove 81, and thereafter returned to the tank 26 in the same manner as described above.

In the embodiment described above, the vibration generating device has been applied to the hydraulic shovel. But, in accordance with the present invention, the vibration generating device may be applied to a rock drill or the like. Further, the vibration generating device of the present invention may be permanently provided in the hydraulic shovel, rock drill or the like. That is, the vibration generating device of the present invention may installed as a component of the hydraulic shovel, rock drill or the like so as not to be replaceable.

As described above, the present invention can provide a vibration generating device which is simple in structure, can be easily replaced and can improve reliability.

What is claimed is:

1. A vibration generating device comprising:

a block-shaped casing having a supply opening to which a high pressure fluid is supplied and an exhaust opening from which a low pressure is exhausted;

a vibration-generating piston slidably housed in a cylinder chamber formed in the said casing;

a rotary valve housed within said casing, which is connected to said supply opening and said exhaust opening through a supply passage and an exhaust passage, respectively and also connected to portions of said cylinder chamber on both sides of said vibration-generating piston though a pair of fluid passages, said rotary valve rotating to communicate the supply passage with said portions of said cylinder chamber on said both sides alternately, thereby alternately guiding the high pressure fluid to said portions of said cylinder chamber on said both sides;

a fluid motor housed within said casing, which is connected to a supply intermediate passage and an exhaust intermediate passage communicating with said supply passage and said exhaust passage, respectively, said fluid motor being operated by the high pressure fluid supplied through the supply intermediate passage, thereby giving rotary force to said rotary valve; and a flow rate control valve housed within said casing, which is mounted on a portion of the supply intermediate passage, said flow rate control valve controlling an amount of the high pressure fluid supplied to said fluid motor.

2. A vibration generating device according to claim 1, wherein the center axial line of the cylinder chamber, rotary axial line of the rotary valve and center axial line of the flow rate valve are made parallel to one another so that these cylinder chamber, rotary valve and flow rate control valve are arranged in a superposing fashion.

* * * * *